US008191523B2

(12) United States Patent
Sakurai et al.

(10) Patent No.: US 8,191,523 B2
(45) Date of Patent: Jun. 5, 2012

(54) ROCKER ARM

(75) Inventors: Masahide Sakurai, Aichi (JP); Naoki Hiramatsu, Aichi (JP); Eiichi Nozaki, Aichi (JP)

(73) Assignee: OTICS Corporation, Nishio (JP)

( * ) Notice: Subject to any disclaimer, the term of this patent is extended or adjusted under 35 U.S.C. 154(b) by 284 days.

(21) Appl. No.: 12/343,660

(22) Filed: Dec. 24, 2008

(65) Prior Publication Data

US 2009/0194050 A1 Aug. 6, 2009

(30) Foreign Application Priority Data

Feb. 5, 2008 (JP) ..... 2008-025239

(51) Int. Cl.
*F01L 1/18* (2006.01)

(52) U.S. Cl. ..... 123/90.39; 74/559; 123/90.43

(58) Field of Classification Search ..... 123/90.43, 123/90.39, 90.42, 90.46; 74/519, 559
See application file for complete search history.

(56) References Cited

U.S. PATENT DOCUMENTS

| | | | |
|---|---|---|---|
| 5,819,694 | A | 10/1998 | Trutescu et al. |
| 2003/0196629 | A1 | 10/2003 | Ammon et al. |

FOREIGN PATENT DOCUMENTS

| | | |
|---|---|---|
| EP | 1 233 150 A2 | 8/2002 |
| EP | 1 375 830 A1 | 1/2004 |
| JP | 5-272310 | 10/1993 |
| JP | 2002-161717 | 6/2002 |
| JP | 2003-138914 | 5/2003 |

OTHER PUBLICATIONS

Office Action issued Oct. 11, 2011, in Japanese Patent Application No. 2008-025239 (with English-language Translation).

*Primary Examiner* — Zelalem Eshete
(74) *Attorney, Agent, or Firm* — Oblon, Spivak, McClelland, Maier & Neustadt, L.L.P.

(57) ABSTRACT

A rocker arm includes a pair of side wall portions formed so as to face each other, an engaging portion connecting the pair of side wall portions and adapted to engage with a rocking support member arranged in an engine, and a sliding portion connecting the pair of side wall portions and being adapted to be in slidable contact with a stem front end portion of an engine valve. The engaging portion includes a board surface portion connecting the pair of side wall portions and a protruding portion protruding from the board surface portion toward the rocking support member. In the protruding portion, a spherical concave portion adapted to engage with a spherical protruding portion of the rocking support member is formed as a depression.

1 Claim, 7 Drawing Sheets

ROCKER ARM

CROSS-REFERENCES TO RELATED APPLICATIONS

The present application claims priority under 35 U.S.C. §119 to Japanese Application No. 2008-025239, filed Feb. 5, 2008, entitled "ROCKER ARM". The contents of this application are incorporated herein by reference in their entirety.

BACKGROUND OF THE INVENTION

1. Field of the Invention

The present invention relates to a rocker arm which is used in an engine valve opening and closing mechanism.

2. Description of the Related Arts

A valve opening and closing mechanism used in a reciprocal engine of a vehicle or the like is constructed so as to execute suction and exhaust of air in the engine by opening and closing an engine valve by rocking of a rocker arm with receiving rotation of a cam. For example, in an overhead cam (OHC) type engine, a rocker arm supports a roller via a supporting pin between a pair of side wall portions. This rocker arm rocks so as to execute opening and closing of the engine valve while rotating the roller with rotation of the cam.

The engine has a rocking support member such as a pivot, a lash adjuster or the like for forming a rocking support point of the rocker arm. An engaging portion formed at an end of the rocker arm engages with the rocking support member. The engaging portion of the rocker arm is for example in shape of a spherical concave portion depressed toward the opposite direction to the pivot so as to engage with a spherical protruding portion of the pivot, as disclosed in the patent document 1. The engaging portion of the rocker arm is for example in shape of a convex spherical shape projecting toward the direction to the pivot so as to engage with the spherical concave portion formed at the end portion of the pivot as disclosed in the patent document 2.

However, in the above-described conventional rocker arm, the engaging portion engaging with the rocking support member is formed with projecting toward only one direction from a board surface portion connecting a pair of side wall portions. Thus, positional relationship between the rocking support member and the engaging portion in the rocking direction (direction the rocker arm rocks which is vertical or oblique to vertical direction) is restricted.

Furthermore, especially in the case which the pair of side wall portions standing toward the rocking support member is formed to be extended to both side portions of the engaging portion, the pair of side wall portions of the engaging portion might interfere with peripheral members around the rocker arm such as the rocking support member or the like. Therefore, in this case, it is difficult to improve rigidity of the engaging portion of the rocker arm.

Patent document 1: JP2003-138914 Unexamined Patent Publication (Kokai)

Patent document 2: JP2002-161717 Unexamined Patent Publication (Kokai)

SUMMARY OF THE INVENTION

The present invention has been achieved in views of the above-described conventional problems and intends to provide a rocker arm which can reduce interference with peripheral members around the rocker arm at the time of rocking and increase the freedom of design.

The present invention provides a rocker arm comprising:

a pair of side wall portions formed so as to face each other, an engaging portion connecting the pair of side wall portions and adapted to engage with a rocking support member arranged in an engine, a sliding portion connecting the pair of side wall portions and being adapted to be in slidable contact with a stem front end portion of an engine valve, wherein the engaging portion has a board surface portion connecting the pair of side wall portions and a protruding portion protruding from the board surface portion toward the rocking support member, and a spherical concave portion adapted to engage with a spherical protruding portion of the rocking support member is formed as a depression in the protruding portion.

In the rocker arm of the present invention, form of the engaging portion engaging with the rocking support member is devised so that restriction of the positional relationship between the rocking support member and the engaging portion in the rocking direction (direction the rocker arm rocks) is defused.

In concrete terms, in the present invention, the spherical concave portion engaging with the spherical protruding portion of the rocking support member is formed to be depressed from the protruding portion protruding from the board surface portion connecting the pair of side wall portions toward the rocking support member. Consequently, in an engine to which the rocker arm is installed, the formed position of the spherical concave portion in the rocking direction is approximated to the rocking support member more than the formed position of the board surface portion in the rocking direction. Thus, especially, interference between the pair of side wall portions and peripheral members around the rocker arm such as the rocking support member or the like can be reduced.

Accordingly, the rocker arm of the present invention enables to reduce interference with peripheral members around the rocker arm such as the rocking support member or the like at the time of rocking and increase the freedom of design.

DESCRIPTION OF THE PREFERRED EMBODIMENTS

The preferred embodiments of the above-described invention will be described.

In the present invention, as the rocking support member, a pivot which has the spherical protruding portion, a lash adjuster adjusting gaps between a cam and a rocker arm and between a rocker arm and an engine valve by applying bias force to the spherical convex portion or the like can be used.

Further, it is preferable that the pair of side wall portions extends from the engaging portion and the sliding portion toward the rocking support member by bending a flat metal plate material, an opening arranged between the engaging portion and the sliding portion, the pair of side wall portions comprises the left and right side portions of the opening and the left and right side portions of the engaging portion and the sliding portion which are extended from the left and right side portions of the opening, the protruding portion has a bottom portion inside of a ring-shaped standing portion standing from the board surface portion, and the spherical concave portion is formed so that it forms a depression in the bottom portion.

In this case, the protruding portion and the spherical concave portion can be formed easily by being subjected to drawing process, upsetting process or the like on a flat metal plate material.

Further, in this case, interference between the pair of side wall portions formed so as to be extended to the left and right side portions of the engaging portion and peripheral members around the rocker arm such as the rocking support member or the like can be reduced. Thus, it can be easy to form the pair of side wall portions at the left and right side portions of the engaging portion. Then, rigidity of the rocker arm can be improved effectively by raising the height of the pair of side wall portions.

Embodiment

Hereinafter, the embodiment of the rocker arm of the present invention will be described with reference accompanying drawings.

Figure 1:
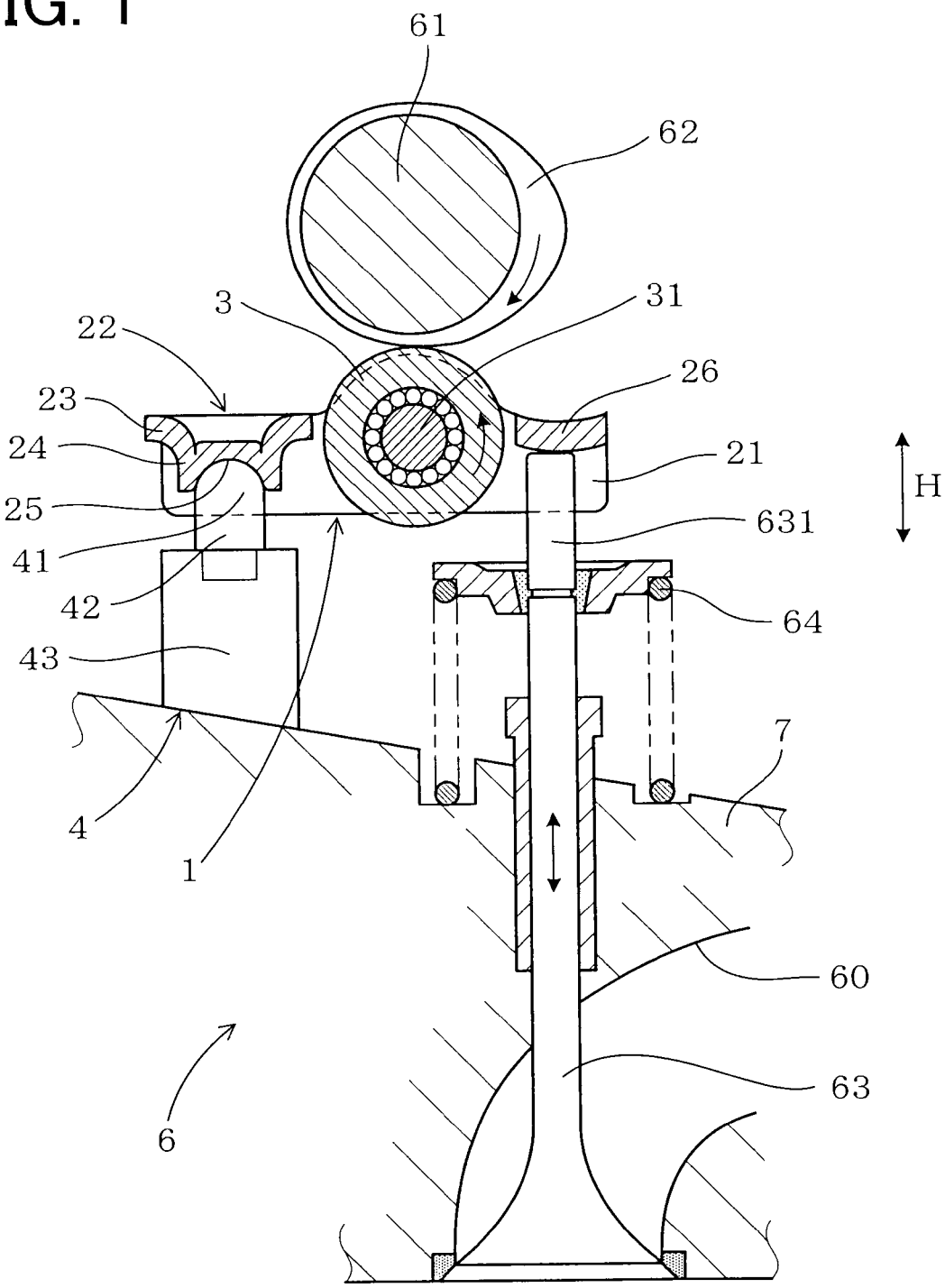
FIG. 1 is a sectional explanatory diagram showing a valve opening and closing mechanism using the rocker arm, according to the embodiment.
Figure 2:
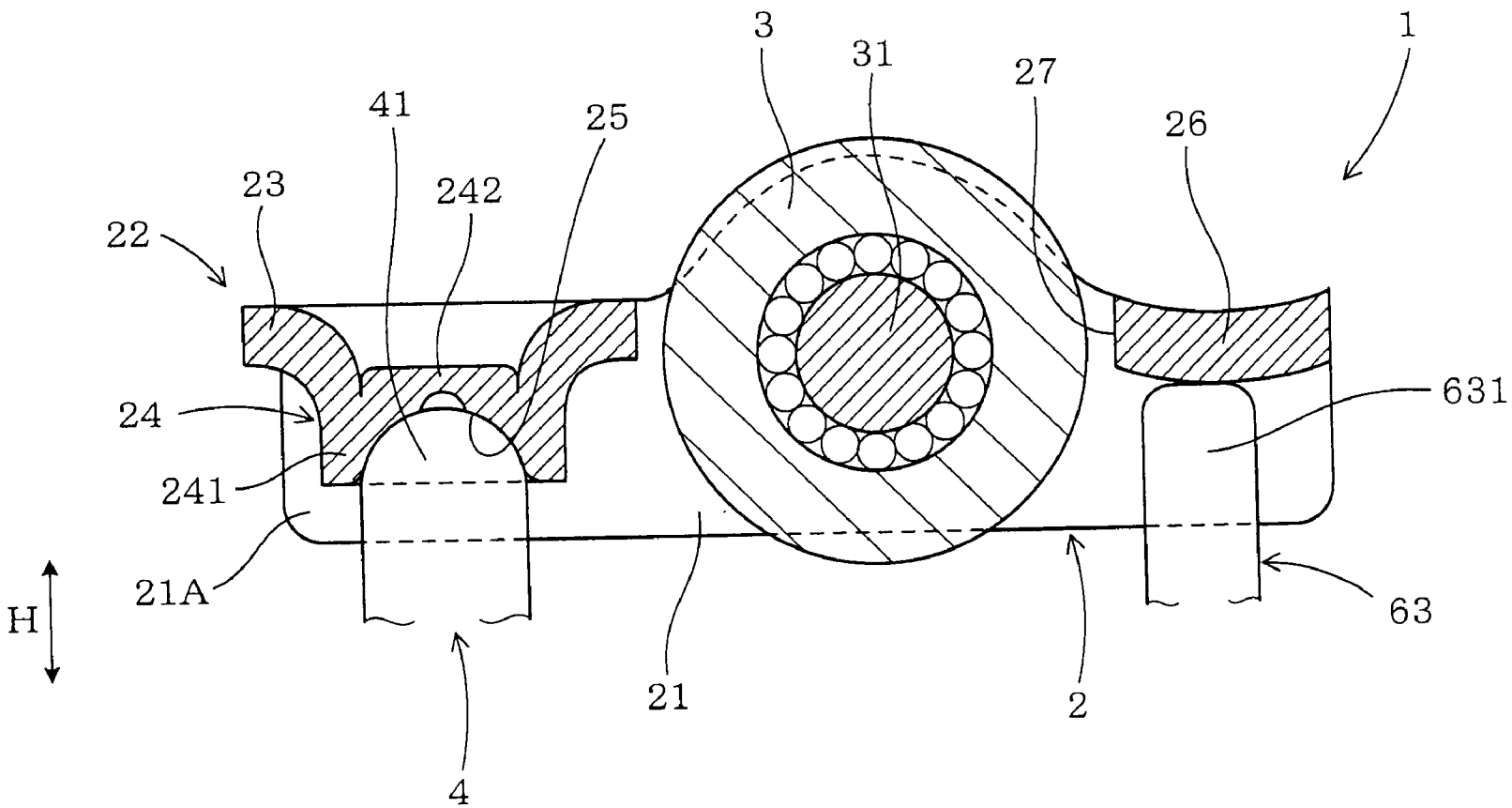
FIG. 2 is a figure showing the rocker arm which is corresponding to a sectional explanatory diagram taken along the arrow A-A in FIG. 4, according to the embodiment.

As shown in FIGS. 1 and 2, the rocker arm 1 of this embodiment has a pair of side wall portions 21 formed so as to face each other, an engaging portion 22 connecting the pair of side wall portions 21 and adapted to engage with a rocking support member 4 arranged on a cylinder head 7 of an engine, a sliding portion 26 connecting the pair of side wall portions 21 and being adapted to be in slidable contact with a stem front end portion 631 of an engine valve 63.

Figure 3:
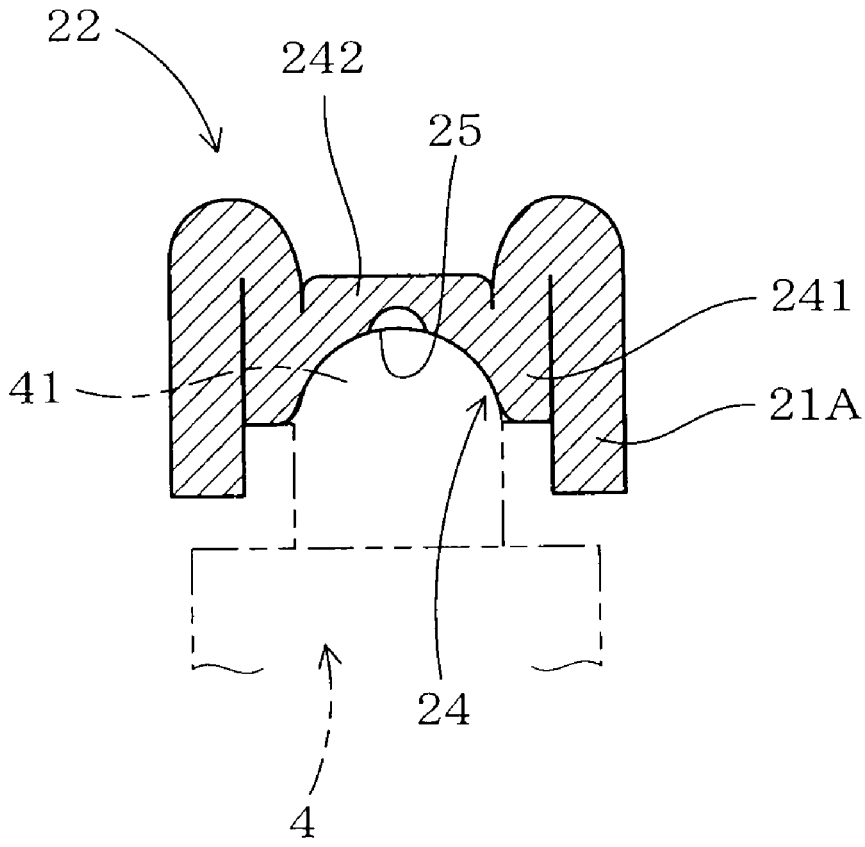
FIG. 3 is a figure showing the periphery of the engaging portion which is corresponding to a sectional explanatory diagram taken along the arrow B-B in FIG. 4, according to the embodiment.

As shown in FIG. 3, the engaging portion 22 has a board surface portion 23 connecting the pair of side wall portions 21 and a protruding portion 24 protruding from the board surface portion 23 toward the rocking support member 4. In the protruding portion 24, a spherical concave portion 25 engaging with a spherical protruding portion 41 of the rocking support member 4 is formed as a depression.

Figure 4:
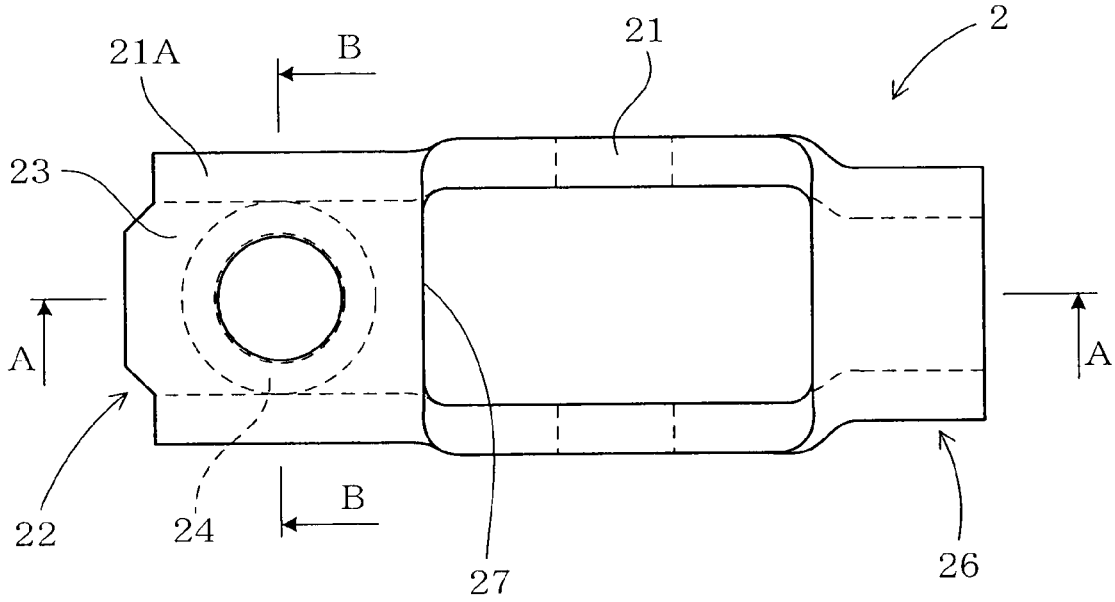
FIG. 4 is a plane view showing an arm body portion of the rocker arm, according to the embodiment.

FIG. 1 shows a valve opening and closing mechanism 6. FIGS. 2 and 4 show the rocker arm 1. FIG. 3 shows the engaging portion 22 of the rocker arm 1 and the pair of side wall portions 21A formed at the engaging portion 22.

Hereinafter, the rocker arm 1 of this embodiment will be described in detail with reference to FIGS. 1-5.

The rocker arm 1 of this embodiment is used for the valve opening and closing mechanism 6 of an overhead cam (OHC) type reciprocal engine.

As shown in FIG. 1, the valve opening and closing mechanism 6 in this embodiment is constructed by having an engine valve 63 arranged on a suction/exhaust port (suction port and exhaust port) 60 of the engine, the rocker arm 1 which rocks by receiving the rotation of the cam 62 arranged on a camshaft 61 of the engine and opens and closes the engine valve 63 with sliding it, the rocking support member 4 forming a rocking support point of the rocker arm 1, and a coil spring 64 which biases the engine valve 63 toward the direction to close.

The rocker arm 1 drives a roller 3 with a rotation of the cam 62 and rocks vertically around the rocking support member 4 so as to open/close the engine valve 63.

As shown in the same figure, the rocking support member 4 is constructed by a hydraulic lash adjuster (HLA) which can adjust gaps between the cam 62 and the rocker arm 1 and between the rocker arm 1 and a stem front end portion 631 of the engine valve 63 automatically. Details of the hydraulic lash adjuster are omitted. The hydraulic lash adjuster has a plunger portion 42 which forms the spherical protruding portion 41 at the front end, a spring biasing the plunger portion 42 toward the protruding direction of the protruding portion 41, and a body 43 housing the spring and the plunger portion 42. The hydraulic lash adjuster is constructed so as to supply lubricant held in the plunger portion 42 to gap between the spherical protruding portion 41 and the spherical concave portion 25 of the rocker arm 1.

As shown in FIGS. 2 and 4, the rocker arm 1 has an arm body 2 and the roller 3 arranged on the pair of side wall portions 21 of the arm body 2 via a supporting pin 31. The engaging portion 22 formed on one longitudinal end of the arm body 2 connects the pair of side wall portions 21. The sliding portion 26 formed on the other longitudinal end of the arm body 2 connects the pair of side wall portions 21. Further, an opening 27 for disposing the roller 3 is formed between the engaging portion 22 and the sliding portion 26.

The arm body 2 is formed by bending a flat metal plate material 20. The arm body 2 in this embodiment is formed as mentioned below. The pair of side wall portions 21 is formed by being raised up to one side of the engaging portion 22 and the sliding portion 26 (the rocking support member 4 side), then portions in the pair of side wall portions 21 located on the left and right side portions of the opening 27 are transformed to protrude toward the other side portions of the engaging portion 22 and the sliding portion 26 (opposite to the rocking support member 4 side).

As shown in FIGS. 2 and 3, the protruding portion 24 of the engaging portion 22 is formed so as to protrude in the same direction as the direction which the pair of side wall portions 21 is raised from the board surface portion 23 of the frat metal plate material 20.

The sliding portion 26 is formed a curved surface shape, in the condition which its surface sliding in contact with the stem front end portion 631 of the engine valve 63 is convex, when it is seen from the side of the rocker arm 1 (horizontal direction which the pair of side wall portions 21 is opposite) The sliding portion 26 may be formed by being subjected to upsetting process or the like on a surface of the frat metal plate material 20 at which a pair of the siding portions 21 has been formed.

Further, the pair of side wall portions 21 in this embodiment is formed so as to extend on the left and right side portions of the opening 27 to the left and right side portions of the protruding portion 24 of the engaging portion 22 and the sliding portion 26.

The protruding portion 24 in this embodiment has a bottom portion 242 inside of a ring-shaped standing portion 241 standing from the board surface portion 23, and the spherical concave portion 25 is depressed in an approximately hemispherical shape from the bottom portion 242. The spherical concave portion 25 is depressed in the opposite direction to the direction the protruding portion 24 protrudes to.

Figure 5:
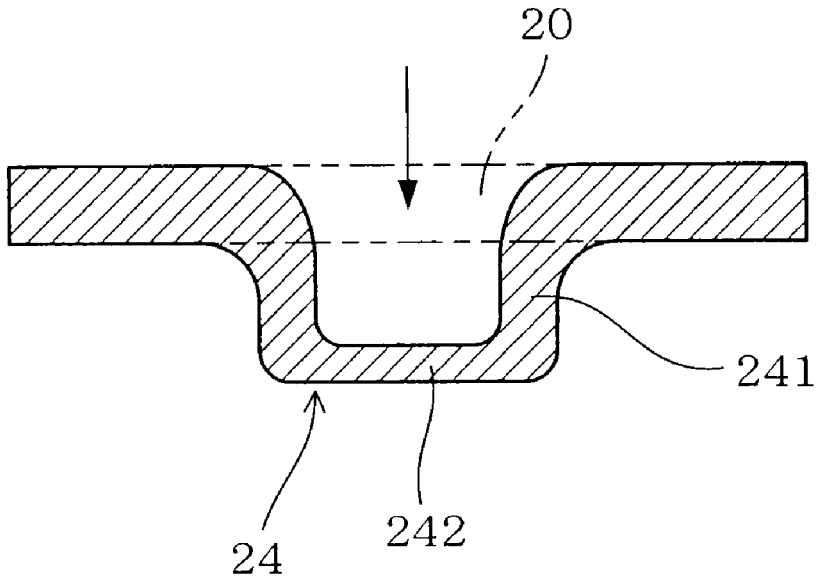
FIG. 5 is a sectional explanatory diagram showing a midstream of the process to form the protruding portion, according to the embodiment.

The protruding portion 24 can be formed as mentioned below. As shown in FIG. 5, the protruding portion 24 having the ring-shaped standing portion 241 and the bottom portion 242 are formed toward one side of the surface of the metal plate material 20 by being subjected to drawing process, upsetting process or the like on the board surface portion 23, then, as shown in FIG. 3, the spherical concave portion 25 is depressed toward the other side of the surface of the plate by being subjected to upsetting process or the like on the bottom portion 242.

Further, the protruding portion 24 and the spherical concave portion 25 may be formed before forming the pair of side wall portions 21 on the frat metal plate material 20, and also may be formed after forming the pair of side wall portions 21 on the frat metal plate material 20.

In the rocker arm 1 of this embodiment, form of the engaging portion 22 engaging with the rocking support member 4 is devised so that restriction of the positional relationship between the rocking support member 4 and the engaging portion 22 in the rocking direction (vertical direction in FIG. 1) H is defused.

In concrete terms, in this embodiment, the spherical concave portion 25 engaging with the spherical protruding portion 41 of the rocking support member 4 is formed so as to be depressed from the protruding portion 24 protrudes from the board surface portion 23 connecting the pair of side wall portions 21 toward the rocking support member 4. Consequently, in the valve opening and closing mechanism 6 to which the rocker arm 1 is installed, the formed position of the spherical concave portion 25 is approximated to the rocking support member 4 more than the formed position of the board surface portion 23 in the rocking direction H.

Accordingly, the rocker arm 1 enables to reduce interference of the pair of side wall portions 21 with peripheral members around the rocking support member 4 or the like when the rocker arm 1 rocks by receiving rotation of the cam 62 and increase the freedom of design.

Further, because the spherical concave portion 25 is formed so as to be depressed from the protruding portion 24, the pair of side wall portions 21A extending to the left and right side portions of the engaging portion 22 can reduce interference with peripheral members around the rocker arm 1 such as the rocking support member 4 or the like. Thus, as shown in FIGS. 2 and 3, it can be easy to form the pair of side wall portions 21 on the left and right side portions of the engaging portion 22. Then, rigidity of the engaging portion 22 of the rocker arm 1 can be improved effectively by raising the height of the pair of side wall portions 21A.

Thus, according to the rocker arm 1 of this embodiment, freedom of design of the rocker arm 1 can be improved and rigidity of the engaging portion 22 can be improved effectively.

(Comparing to a Conventional Rocker Arm)

Figure 6:
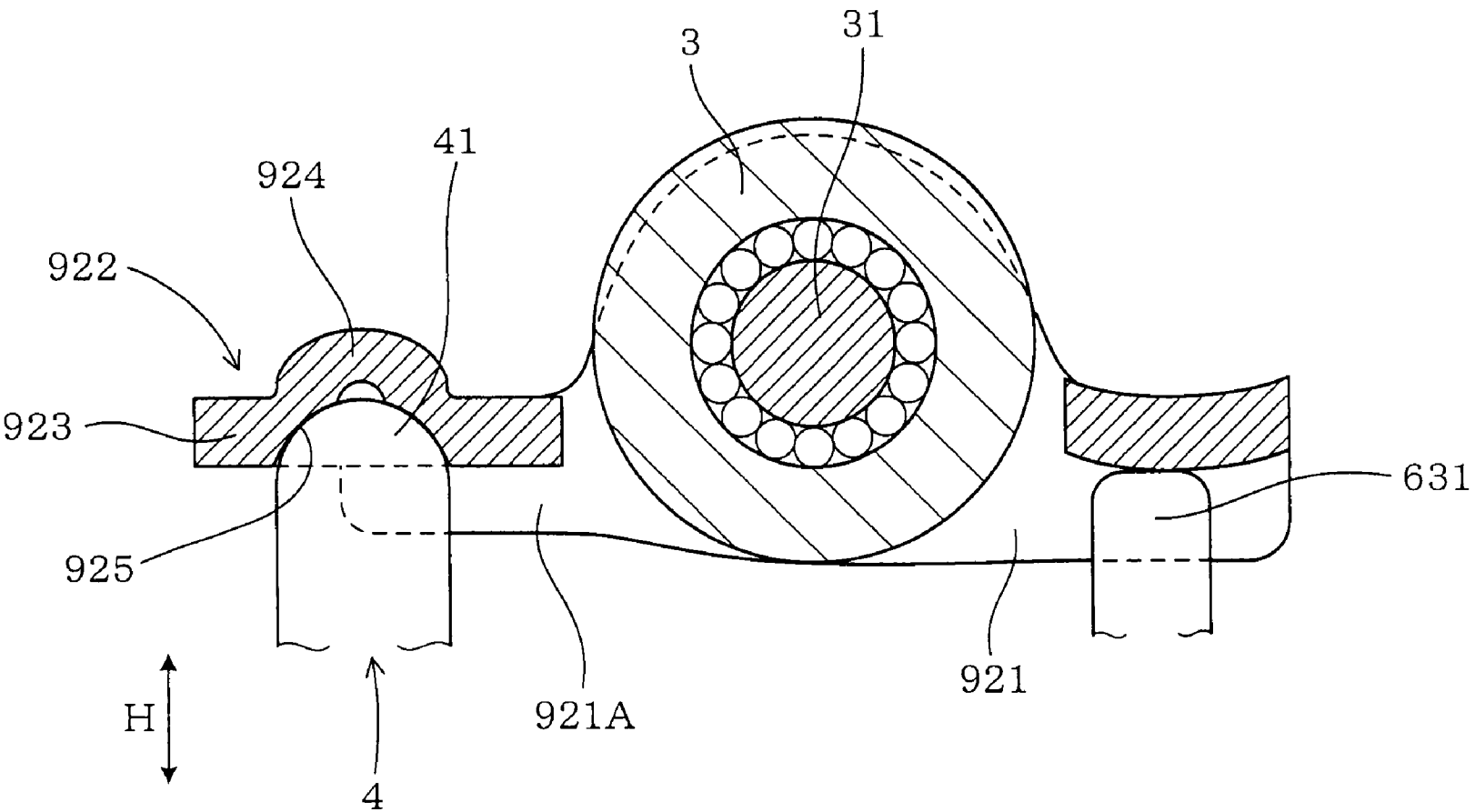
FIG. 6 is a figure showing the rocker arm which is corresponding to a sectional explanatory diagram taken along the arrow A-A in FIG. 4, according to the comparative example.
Figure 7:
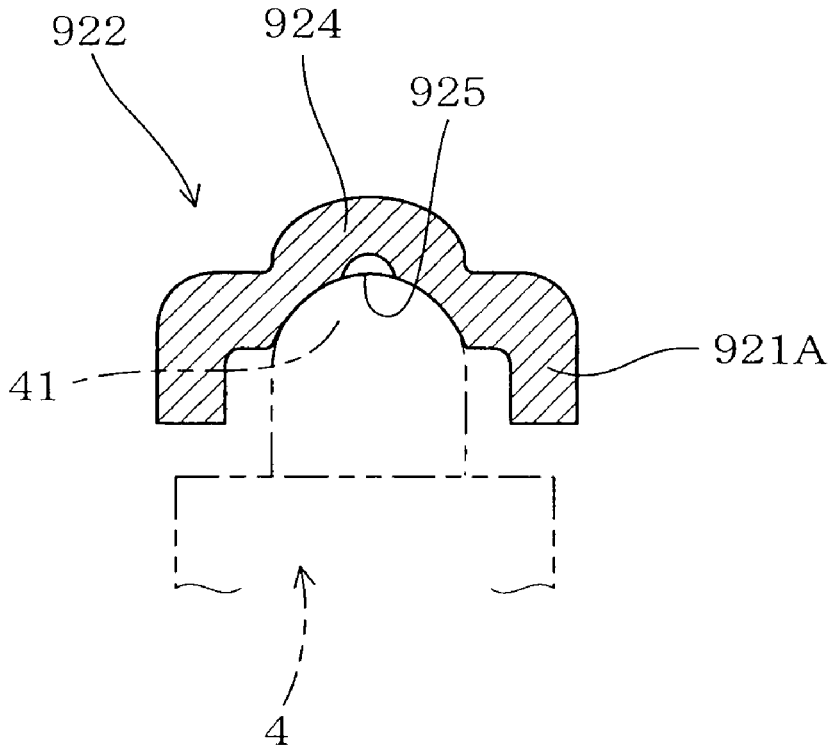
FIG. 7 is a figure showing the periphery of the engaging portion which is corresponding to a sectional explanatory diagram taken along the arrow B-B in FIG. 4, according to the comparative example.

FIG. 6 shows a conventional rocker arm 9. FIG. 7 shows an engaging portion 922 and a pair of side wall portions 921A formed on the engaging portion 922 of the conventional rocker arm 9.

In the conventional rocker arm 9, a spherical concave portion 925 of the engaging portion 922 is formed by protruding a protruding portion 924 in the opposite direction (direction toward a cam 62) to the direction the pair of side wall portions 921 stands from a board surface portion 923 to.

Thus, if heights of the side wall portions 921 extending to the left and right side portions of the engaging portion 922 were raised, the side wall portions 921 might interfere with peripheral members around the rocking support member 4 or the like when the rocker arm 9 rocks. Accordingly, in the conventional rocker arm 9, rigidity of the engaging portion 922 cannot be improved and freedom of design of the rocker arm 1 cannot be improved.

On the other hand, in the rocker arm 1 of this embodiment, as shown in FIGS. 2 and 3, the protruding portion 24 is formed by protruding in the same direction (direction toward the rocking support member 4) as the direction which the pair of side wall portions 21 is raised from the board surface portion 23. The spherical concave portion 25 is formed at the protruding portion 24.

Thus, raising the heights of the side wall portions 21A extending to the left and right side portions of the engaging portion 22 is easy, and freedom of design of the rocker arm 1 can be improved.

The invention claimed is:

1. A rocker arm comprising:

a pair of side wall portions formed so as to face each other, an engaging portion connecting the pair of side wall portions and adapted to engage with a rocking support member arranged in an engine, a sliding portion connecting the pair of side wall portions and being adapted to be in slidable contact with a stem front end portion of an engine valve, wherein the engaging portion includes a board surface portion connecting the pair of side wall portions and a protruding portion protruding from the board surface portion toward the rocking support member, and a spherical concave portion adapted to engage with a spherical protruding portion of the rocking support member is formed as a depression in the protruding portion, wherein the pair of side wall portions extends from the engaging portion and the sliding portion toward the rocking support member by bending a flat metal plate material, an opening is arranged between the engaging portion and the sliding portion, the pair of side wall portions comprises left and right side portions of the opening and left and right side portions of the engaging portion and the sliding portion which are extended from the left and right side portions of the opening, the protruding portion includes a bottom portion inside of a ring-shaped standing portion standing from the board surface portion, and the spherical concave portion is formed so that it forms a depression in a bottom surface of the bottom portion, and wherein an upper surface of the bottom portion above the spherical concave portion is flat and is at a level below the board surface portion.

* * * * *